US006367164B1

(12) United States Patent
Oechsle et al.

(10) Patent No.: US 6,367,164 B1
(45) Date of Patent: Apr. 9, 2002

(54) DRYER SECTION

(75) Inventors: Markus Oechsle, Bartholomae; Gerhard Kotitschke, Steinheim; Roland Mayer, Heidenheim, all of (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/717,158

(22) Filed: Nov. 22, 2000

(30) Foreign Application Priority Data

Dec. 10, 1999 (DE) ..... 199 59 669

(51) Int. Cl.[7] ..... F26B 3/00

(52) U.S. Cl. ..... 34/448; 34/117; 34/120; 34/457

(58) Field of Search ..... 34/448, 114, 116, 34/117, 120, 121, 123, 126, 457, 458, 466

(56) References Cited

U.S. PATENT DOCUMENTS

| | | | | | |
|---|---|---|---|---|---|
| 5,101,577 | A | * | 4/1992 | Wedel | 34/114 |
| 5,205,052 | A | | 4/1993 | Kraft et al. | |
| 5,295,311 | A | * | 3/1994 | Kotitschke et al. | 34/117 |
| 5,319,863 | A | * | 6/1994 | Kotitschke et al. | 34/117 |
| 5,355,593 | A | | 10/1994 | Kotitchke | |
| 5,526,579 | A | * | 6/1996 | Kade et al. | 34/117 |
| 5,537,755 | A | * | 7/1996 | Kotitschke | 34/117 |
| 5,632,101 | A | * | 5/1997 | Oechsle | 34/117 |
| 5,743,024 | A | * | 4/1998 | Oechsle | 34/117 |
| 5,752,325 | A | * | 5/1998 | Kotitschke | 34/117 |
| 5,771,603 | A | * | 6/1998 | Kotitschke et al. | 34/117 |
| 6,088,926 | A | * | 7/2000 | Steiner et al. | 34/117 |
| 6,131,304 | A | * | 10/2000 | Egelhof et al. | 34/117 |
| 6,145,218 | A | * | 11/2000 | Kotitschke et al. | 34/457 |

FOREIGN PATENT DOCUMENTS

| | | |
|---|---|---|
| DE | 4201107 | 10/1993 |
| DE | 4220682 | 12/1993 |
| EP | 426607 | 5/1991 |

* cited by examiner

*Primary Examiner*—Teresa Walberg
*Assistant Examiner*—Fadi H. Dahbour
(74) *Attorney, Agent, or Firm*—Greenblum & Bernstein, P.L.C.

(57) ABSTRACT

Dryer section and process for drying a fibrous web. Dryer section includes a plurality of dryer groups with at least one heated dryer cylinder and at least one belt to press the fibrous web against a surface of the at least one heated dryer cylinder. Transfer elements, i.e., a delivery transfer element and an accepting transfer element, are arranged to form at least one transfer point. Accepting transfer element has a greater speed than the delivering transfer element, and the transfer elements are arranged not to press against each other at the transfer point and to have a distance from one another of less than about 70 mm. Process includes guiding fibrous web to a first dryer group, pressing, with the at least one belt, fibrous web against surfaces of the at least one heated dryer cylinders of each dryer group, and transferring, without pressing, fibrous web between transfer elements.

26 Claims, 1 Drawing Sheet

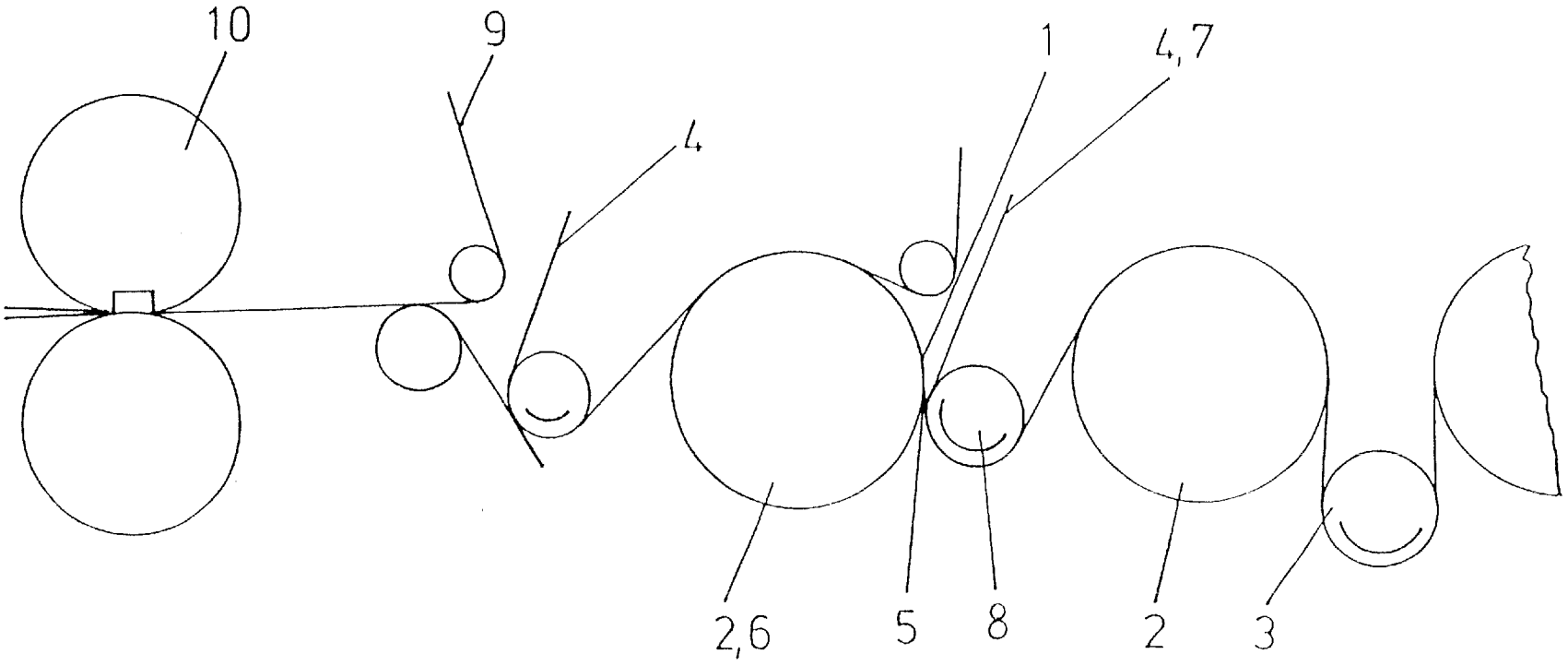
10
9
4
1
4,7
2,6
5
8
2
3

DRYER SECTION

CROSS-REFERENCE TO RELATED APPLICATIONS

The present application claims priority under 35 U.S.C. § 119 of German Patent Application No. 199 59 669.7, filed on Dec. 10, 1999, the disclosure of which is expressly incorporated by reference herein in its entirety.

BACKGROUND OF THE INVENTION

1. Field of the Invention

The invention relates to a dryer section for drying a fibrous web, in particular a paper, cardboard, or tissue web, in machines for the production and/or processing thereof, including several dryer groups in which the fibrous web is guided over heated drying cylinders and guiding rolls with the fibrous web being pressed by at least one belt of the corresponding drying group against the jacket surface of the drying cylinder and with the fibrous web being transferred at at least one transfer point between two idling transfer elements and with the accepting element having a higher speed than the delivering transfer element.

2. Discussion of Background Information

Due to the impact of exterior forces, such as adhesive forces on rolls and belts, centrifugal forces, as well as forces-caused by vacuums or airflow, stretching occurs in moist fibrous webs, particularly in press sections and dryer sections. These stretches can then cause the formation of folds or even breaks.

In order to support the transfer of the fibrous web between the two transfer elements and to compensate for stretching, the accepting transfer elements are frequently driven at a higher speed, i.e., tension is created at the transfer point.

Here, the transfer of the fibrous web usually occurs from the last drying cylinder of a dryer group to the drying wire of the subsequent dryer group with the drying wire at least slightly wrapping around the drying cylinder. This wrapping ensures, on the one hand, a secure transfer of the fibrous web, in particular at high web travel speeds; on the other hand, however, it limits the maximum speed difference between the transfer elements.

SUMMARY OF THE INVENTION

Therefore, the present invention creates a possibility for achieving a speed difference between the transfer elements that is as small as possible, but sufficient, at the same time, to secure a safe guidance and transfer of the fibrous web at the transfer point.

According to the present invention, the transfer elements are not pressed against each other with a speed difference at the transfer point and that they have a distance from one another of less than about 70 mm.

Squeezing of the fibrous web between the transfer elements is thus omitted, which allows higher speed differences without any negative effects on the paper quality. The distance between the transfer elements is so small, however, that a secure guidance of the fibrous web is provided.

Here, it is advantageous for the distance between the transfer elements to be larger than zero and smaller than about 35 mm at the transfer point with a speed difference.

Here, the transfer elements can be embodied as rolls, preferably as drying cylinders, and/or as belts, preferably as drying belts. If a belt is used, it is advantageous for the accepting transfer element to be embodied as a belt and to be guided at the transfer point via a suction element, preferably in the form of a suctioned roll. Here, the suction element supports the transfer and the adhesion of the fibrous web on the accepting belt.

If one transfer element is formed by a roll, the other transfer element should be a belt. This allows the sagging of the rolls, which are frequently very large, at the formation of the transfer point to be omitted. However, the belt should not wrap around the roll at the transfer point in order to minimize the effects of force on the fibrous web.

It is particularly advantageous to use the arrangement in an area of high water content, i.e., also increased stretching of the fibrous web at the beginning of the dryer section, particularly between the first and the second dryer groups.

In order to allow the creation of a speed difference, i.e., a tension, behind the dryer section as quickly as possible, the first dryer group should have only one or two drying cylinders, preferably one. Here, the speed of the accepting transfer element at the transfer point should be a maximum of about 2.5% higher, preferably about 0.5 to 2.0% higher, than the speed of the delivering transfer element between the first and the second dryer group.

The present invention is directed to a dryer section for drying a fibrous web in machines for producing and/or processing the fibrous web. The dryer section includes a plurality of dryer groups, in which each dryer group includes at least one heated dryer cylinder and at least one belt arranged to press the fibrous web against a jacket surface of the at least one heated dryer cylinder, and, wherein at least one of the dryer groups further includes guide rolls. Transfer elements, including a delivery transfer element and an accepting transfer element, are arranged to form at least one transfer point. The accepting transfer element has a greater speed than the delivering transfer element, and the transfer elements are arranged not to press against each other at the transfer point and to have a distance from one another of less than about 70 mm.

According to a feature of the instant invention, the fibrous web can include one of a paper, cardboard, and tissue web.

In accordance with another feature of the invention, the distance between the transfer elements at the transfer point may be greater than zero and smaller than about 35 mm.

Further, at least one of the transfer elements can include a roll, and the roll may include a dryer cylinder.

Still further, at least one of the transfer elements can include a belt, and the belt of the at least one transfer element may include a drying wire. Further, a suction element may be included, and the at least one transfer element can be the accepting transfer element, and the belt of the accepting transfer element may be arranged, at the transfer point, to be guided over the suction element. The suction element may include a suctioned roll.

Moreover, the transfer elements can include a roll and a belt, and the belt is arranged so as not to wrap around the roll at the transfer point.

According to a further feature of the present invention, the transfer elements may include belts arranged to travel together for a distance, as short as possible, at the transfer point.

In accordance with still another feature of the invention, a first dryer group may have only one or two dryer cylinders. Further, the first dryer group can include only one dryer cylinder.

The transfer point may be arranged between a first dryer group and a second dryer group, such that the speed difference between the transfer elements is arranged between the first dryer group and the second dryer group. The speed of the accepting transfer element at the transfer point may be maximally about 2.5% higher than the speed of the delivering transfer element. Further, the speed of the accepting transfer element at the transfer point can be between about 0.5 to 2.0% higher than the speed of the delivering transfer element.

The distance between the transfer elements may be greater than a thickness of the web and less than about 35 mm.

The present invention is directed to a process of producing and/or processing a fibrous web in an apparatus that includes a dryer section having a plurality of dryer groups and a transfer point, where each dryer group includes at least one heated dryer cylinder and at least one belt, where at least one dryer group further includes guide rolls, and where the transfer point is formed between transfer elements arranged a distance from each other of about 70 mm. The process includes guiding the fibrous web to a first dryer group, pressing, with the at least one belt, the fibrous web against jacket surfaces of the at least one heated dryer cylinders of each dryer group, and transferring, without pressing, the fibrous web between the transfer elements.

According to a feature of the present invention, the distance between the transfer elements at the transfer point may be greater than zero and smaller than about 35 mm.

Further, the distance between the transfer elements at the transfer point may be greater than a thickness of the fibrous web and smaller than about 35 mm.

In accordance with another feature of the invention, the transfer elements may include a roll and a belt, in which the belt is arranged so as not to wrap around the roll at the transfer point.

According to still another feature of the instant invention, the transfer point may be located between a first dryer group and a second dryer group.

Moreover, the transfer elements may include an accepting transfer element and a delivering transfer element, and the process can further include driving the accepting transfer element at the transfer point at a speed which is maximally about 2.5% higher than a speed of the delivering transfer element. The accepting transfer element at the transfer point can be driven at a speed between about 0.5 to 2.0% higher than the speed of the delivering transfer element.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of non-limiting a example of an exemplary embodiment of the present invention, wherein:

The drawing depicts a schematic representation of an end of a press section and a beginning of a dryer section.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The fibrous web 1 travels in the press section through at least one press nip formed by two press rolls 10. The water, squeezed out in the press nip, is absorbed by continuous circulating press felts 9 that are guided through the press nip along with the fibrous web 1. Here occurs, e.g., the acceptance of the fibrous web 1 from the press felt 9 of the lower press roll 10 of the last or only press nip and its transport via a permeable belt 4 in the form of a drying wire. The acceptance is supported by a suctioned guiding roll wrapped by a belt 4. For this purpose, the suctioned guidance roll has a perforated roll jacket whose interior area is connected to a vacuum source.

The belt 4 guides the fibrous web 1 to the single heated drying cylinder 2 of the first dryer group of the dryer section and presses the fibrous web 1 against the jacket surface of the heated drying cylinder 2. This results in heating of the fibrous web 1 and in evaporation of the moisture contained therein.

The belt 4 can also be embodied as an airtight transfer belt or as a permeable transfer felt which guides the fibrous web 1 from the press section to the first drying cylinder 2 of the dryer section and can even travel together with the fibrous web 1 through the last press nip of the press section.

After the removal of the belt 4 of the first dryer group, the fibrous web 1 continues to travel to the transfer point 5 on the drying cylinder 2. At the transfer point 5, the fibrous web 1 is accepted from a belt 4 in the form of a permeable drying wire of the second dryer group. In the second dryer group, this belt 4 guides the fibrous web 1 alternately over heated drying cylinders 2 provided in the upper row and suctioned guidance rolls 3, provided in a lower row, with the fibrous web 1 being pressed against the jacket surface of the drying cylinder 2.

The transfer of the fibrous web 1 between the transfer element 6 formed by the drying cylinder 2 of the first dryer group and the transfer element 7 formed by the belt 4 of the second dryer group is supported here by a suction element 8. Here, the belt 4 wraps around the suction element 8 embodied as a suctioned guidance roll.

At the transfer point 5, the distance between the transfer elements 6, 7 is smaller than about 35 mm; however, no press nip is formed between the drying cylinder 2 of the first dryer group and the suction element 8. A sufficiently strong tension can be created between the two dryer groups since no wrapping of the drying cylinder 2 of the first dryer group by the belt 4 of the second dryer group occurs either. Here, it is usually sufficient for the speed of the accepting transfer element 7 to be about 0.5% to 2% higher than that of the delivering transfer element 6. On the other hand, the distance between the transfer elements 6, 7 is so small that a secure guidance of the fibrous web 1 is not endangered. Additionally, the guidance is also stabilized by the suction element 8.

Aside from creating tensions for stretching compensation in the press section, the possibility results of creating a tension at the beginning of the drying section quickly thereafter due to the short first dryer group. This tension can now be designed to be sufficiently strong without any negative effects on the quality of the fibrous web 1.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A dryer section for drying a fibrous web in machines for producing and/or processing the fibrous web, comprising:

a plurality of dryer groups, in which each dryer group includes at least one heated dryer cylinder and at least one belt arranged to press the fibrous web against a jacket surface of the at least one heated dryer cylinder, and, wherein at least one of said dryer groups further includes guide rolls; and transfer elements, comprising a delivery transfer element and an accepting transfer element, arranged to form at least one transfer point;

said accepting transfer element having a greater speed than said delivering transfer element; and said transfer elements being arranged not to press against each other at said transfer point and to have a distance from one another of less than about 70 mm, wherein said transfer point is arranged between a first dryer group and a second dryer group, whereby the speed difference between said transfer elements is arranged between said first dryer group and said second dryer group.

2. The dryer group in accordance with claim 1, wherein the fibrous web comprises one of a paper, cardboard, and tissue web.

3. The dryer group in accordance with claim 1, wherein the distance between said transfer elements at said transfer point is greater than zero and smaller than about 35 mm.

4. The dryer group in accordance with claim 1, wherein at least one of said transfer elements comprises a roll.

5. The dryer section in accordance with claim 4, wherein said roll comprises a dryer cylinder.

6. The dryer group in accordance with claim 1, wherein at least one of said transfer elements comprises a belt.

7. The dryer group in accordance with claim 6, wherein said belt of said at least one transfer element comprises a drying wire.

8. The dryer section in accordance with claim 7, further comprising a suction element, wherein said at least one transfer element is said accepting transfer element, and said belt of said accepting transfer element is arranged, at said transfer point, to be guided over said suction element.

9. The dryer section in accordance with claim 8, wherein said suction element comprises a suctioned roll.

10. The dryer group in accordance with claim 1, wherein said transfer elements comprise a roll and a belt.

11. The dryer section in accordance with claim 10, wherein said belt is arranged so as not to wrap around said roll at said transfer point.

12. The dryer group in accordance with claim 1, wherein said transfer elements comprise belts arranged to travel together for a distance, as short as possible, at said transfer point.

13. The dryer group in accordance with claim 1, wherein a first dryer group has only one or two dryer cylinders.

14. The dryer group in accordance with claim 1, wherein said first dryer group comprises only one dryer cylinder.

15. The dryer section in accordance with claim 1, wherein the speed of said accepting transfer element at said transfer point is maximally about 2.5% higher than the speed of said delivering transfer element.

16. The dryer section in accordance with claim 15, wherein the speed of the accepting transfer element at the transfer point is between about 0.5 to 2.0% higher than the speed of said delivering transfer element.

17. The dryer group in accordance with claim 1, wherein the distance between said transfer elements is greater than a thickness of said web and less than about 35 mm.

18. A process of producing and/or processing a fibrous web in an apparatus comprising a dryer section having a plurality of dryer groups and a transfer point, where each dryer group includes at least one heated dryer cylinder and at least one belt, where at least one dryer group further include guide rolls, and where the transfer point is formed between transfer elements arranged a distance from each other of about 70 mm, said process comprising:

guiding the fibrous web to a first dryer group;

pressing, with said at least one belt, the fibrous web against jacket surfaces of said at least one heated dryer cylinders of each dryer group; and transferring, without pressing, the fibrous web between the transfer elements, wherein the transfer point is located between a first dryer group and a second dryer group.

19. The process in accordance with claim 18, wherein the distance between said transfer elements at said transfer point is greater than zero and smaller than about 35 mm.

20. The process in accordance with claim 18, wherein the distance between said transfer elements at said transfer point is greater than a thickness of the fibrous web and smaller than about 35 mm.

21. The process in accordance with claim 18, wherein the transfer elements comprise a roll and a belt, in which the belt is arranged so as not to wrap around the roll at the transfer point.

22. A process of producing and/or processing a fibrous web in an apparatus comprising a dryer section having a plurality of dryer groups and a transfer point, where each dryer group includes at least one heated dryer cylinder and at least one belt, where at least one dryer group further include guide rolls, and where the transfer point is formed between transfer elements arranged a distance from each other of about 70 mm, said process comprising:

guiding the fibrous web to a first dryer group;

pressing, with said at least one belt, the fibrous web against jacket surfaces of said at least one heated dryer cylinders of each dryer group; and transferring, without pressing, the fibrous web between the transfer elements, wherein the transfer elements comprise an accepting transfer element and a delivering transfer element, and the process further comprises:

driving the accepting transfer element at the transfer point at a speed which is maximally about 2.5% higher than a speed of the delivering transfer element.

23. The process in accordance with claim 22, wherein the accepting transfer element at the transfer point is driven at a speed between about 0.5 to 2.0% higher than the speed of the delivering transfer element.

24. The process in accordance with claim 22, wherein the distance between said transfer elements at said transfer point is greater than zero and smaller than about 35 mm.

25. The process in accordance with claim 22, wherein the distance between said transfer elements at said transfer point is greater than a thickness of the fibrous web and smaller than about 35 mm.

26. The process in accordance with claim 22, wherein the transfer elements comprise a roll and a belt, in which the belt is arranged so as not to wrap around the roll at the transfer point.

* * * * *